US006802277B1

(12) United States Patent
Clay et al.

(10) Patent No.: US 6,802,277 B1
(45) Date of Patent: Oct. 12, 2004

(54) FIRE ESCAPE LIGHT AND ALARM

(76) Inventors: Durell Clay, 4735 Girard Ave. North., Minneapolis, MN (US) 55430; Alfonso Clay, 6750 S. Ada St., Chicago, IL (US) 60636

( * ) Notice: Subject to any disclaimer, the term of this patent is extended or adjusted under 35 U.S.C. 154(b) by 245 days.

(21) Appl. No.: 10/120,112

(22) Filed: Apr. 11, 2002

(51) Int. Cl.[7] ..... G08D 17/04

(52) U.S. Cl. ..... 116/101; 116/4; 116/5; 116/7; 116/67 R; 116/103; 40/570; 362/34; 362/276

(58) Field of Search ..... 116/3, 4, 101, 116/207, 216, 217, 5, 7, 67 R, 102, 106, 202, 103, DIG. 1; 340/815.42, 815.69, 815.7, 815.75, 386.1, 404.1; 40/570, 542, 455, 906; 362/34, 276, 86; 374/161, 122

(56) References Cited

U.S. PATENT DOCUMENTS

| | | | | | |
|---|---|---|---|---|---|
| 656,434 | A | | 8/1900 | Vogel | 340/815.71 |
| 1,800,801 | A | | 4/1931 | Olaf | 116/101 |
| 3,493,484 | A | | 2/1970 | Berg et al. | |
| 3,500,033 | A | | 3/1970 | Cole, Jr. et al. | |
| 3,539,794 | A | | 11/1970 | McKay et al. | |
| 3,764,796 | A | | 10/1973 | Gilliam et al. | 362/34 |
| 3,785,334 | A | * | 1/1974 | Waldeck | 116/106 |
| 3,844,248 | A | * | 10/1974 | Parker | 116/202 |
| 3,938,115 | A | * | 2/1976 | Jacoby | 340/521 |
| 3,940,604 | A | | 2/1976 | Rauhut | |
| 4,016,762 | A | * | 4/1977 | Payne | 116/217 |
| 4,121,533 | A | * | 10/1978 | Pappas et al. | 116/5 |
| 4,148,022 | A | | 4/1979 | Hetznecker | |
| 4,193,222 | A | * | 3/1980 | Deschand | 446/215 |
| 4,227,191 | A | | 10/1980 | Raber | |
| 4,524,304 | A | | 6/1985 | Todd | |
| 4,664,199 | A | * | 5/1987 | Grant et al. | 169/46 |
| 4,771,724 | A | * | 9/1988 | Baretz et al. | 116/202 |
| 4,931,780 | A | * | 6/1990 | LaMont et al. | 340/691.6 |
| 5,140,301 | A | | 8/1992 | Watanabe | |
| 5,252,949 | A | | 10/1993 | Kirby et al. | |
| 5,406,463 | A | * | 4/1995 | Schexnayder, Sr. | 362/34 |
| 5,446,629 | A | | 8/1995 | Steiger et al. | |
| 5,552,775 | A | | 9/1996 | Harley | |
| 5,574,434 | A | | 11/1996 | Liu | |
| 5,697,175 | A | * | 12/1997 | Schwartz | 40/552 |
| 5,825,294 | A | | 10/1998 | Krueger | |
| 5,945,924 | A | | 8/1999 | Marman et al. | |
| 6,033,080 | A | | 3/2000 | Hasegawa et al. | |
| 6,481,870 | B2 | * | 11/2002 | Son | 362/259 |
| 2003/0192216 | A1 | * | 10/2003 | Hsu | 40/570 |

OTHER PUBLICATIONS

Howstuffworks "How Light Sticks Work" web page, Feb. 2002.

* cited by examiner

*Primary Examiner*—Diego Gutierrez
*Assistant Examiner*—Travis Reis

(57) ABSTRACT

A emergency sign emits a non-electrical light and sounds a non-electrical alarm when an elevated level of heat is sensed, such heat from a fire, to provide a combined light and a sound alert signals. The light results from the mixing of a chemical compound having chemiluminescent properties. The light illuminates indicia located on the face plate of the sign. The alarm is sounded by releasing compressed gas from a cartridge and directing the released gas through a whistle.

20 Claims, 3 Drawing Sheets

FIRE ESCAPE LIGHT AND ALARM

FIELD OF THE INVENTION

The invention relates to the field of fire alarms. The alarms are heat activated non-electric light emitting and sound generating devices.

BACKGROUND OF THE INVENTION

During a fire in a building structure, such as a residential home, apartment building or office building, electric power may terminate whereby electrical light and electrical sound alarms are rendered useless in cases of emergency. Also, often batteries in conventional battery operated fire and smoke detectors are not routinely changed and neglected by home and building owners. The batteries eventually discharge rendering the alarms inoperative. Electric sparks from electric alarm systems may ignite gases or chemicals present in the environment during a disaster situation.

Marman et al in U.S. Pat. No. 5,945,924 disclose a fire and smoke detection control system that senses the temperature of the fire using a thermocouple. This device does not include a non-electric light system.

Harley in U.S. Pat. No. 5,552,775 discloses a fire detection system that monitors a plurality of zones and indicates the area on a building where a fire is located. This system does not disclose a non-electric light emitting system.

Krueger in U.S. Pat. No. 5,825,294 discloses a heat sensing system for detecting a fire. This system is electrically operated and does not disclose a non-electric light emitting system.

Lui in U.S. Pat. No. 5,574,434 discloses a multistaged heat detection system. The system likewise does not teach a non-electric light emitting system.

SUMMARY OF THE INVENTION

The invention is directed to a non-electric alarm system that emits non-electrical chemiluminescent light and produces a non-electrical, high decibel audible alert signal when the alarm system is subjected to a predetermined heat level from a heat source, such as a fire. The alarm system has a housing having a front plate and a back plate surrounding an inner core having a chamber for accommodating a chemiluminescent solution to emit chemiluminescent light visible through indicia located on the front plate. An admixing member connected to the back plate functions to prepare and deliver the chemiluminescent solution to the chamber. The admixing member has a plurality to tubes. At least one of the tubes contains a first solution. The other tubes contain a second solution separate from the first solution. A sound alarm is connected to the back plate adjacent the admixing member. The sound alarm is operable to produce an audible sound alert. An actuation mechanism operably connected to the admixing member and sound alarm is responsive to a predetermined heat level to simultaneously activate the admixing member and the sound alarm thereby simultaneously causing the first and second solutions to be moved from the tubes into the chamber to prepare the chemiluminescent solution, illuminate the indicia and produce an audible sound alert.

DESCRIPTION OF PREFERRED EMBODIMENTS

Figure 1:
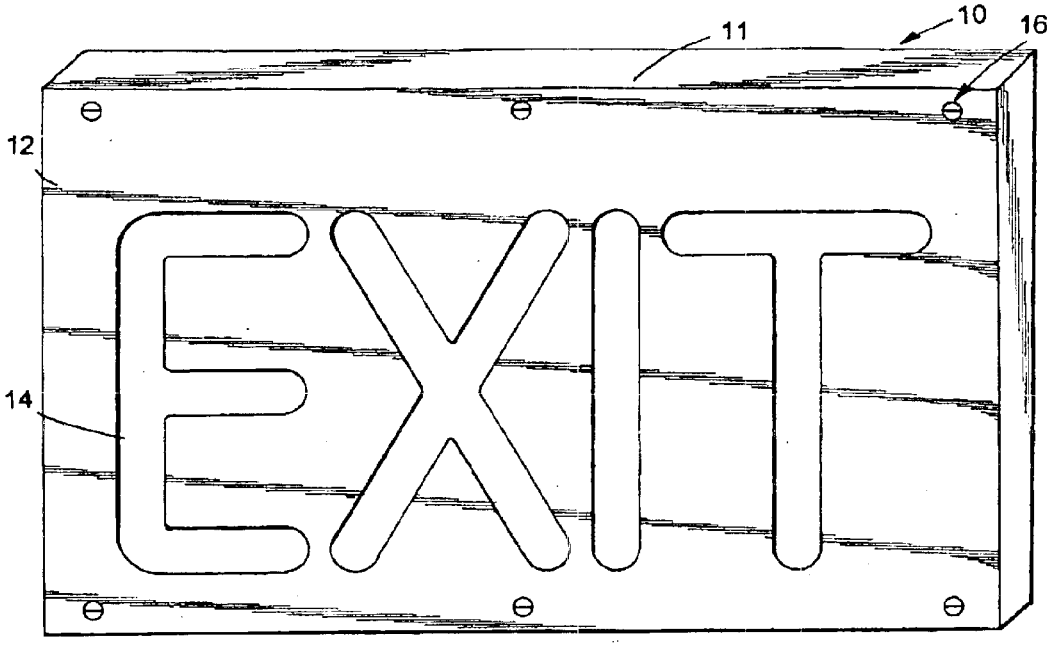
FIG. 1 is a front perspective view of a light and sound alarm system of the invention.
Figure 2:
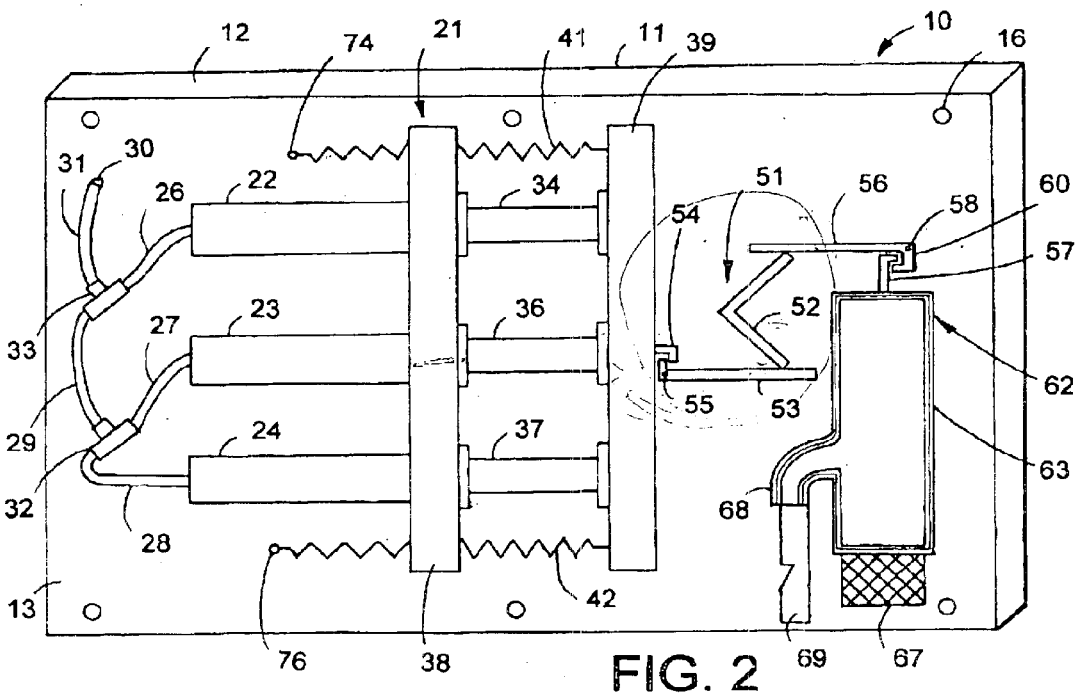
FIG. 2 is a rear perspective view of FIG. 1.

Referring to FIGS. 1 and 2, there is shown a light and sound alarm system of the invention, indicated generally at 10. Alarm system 10 is responsive to heat build-up resulting from an enclosed fire to simultaneously provide a light source and an audible alert signal. Alarm system 10 can be used as a primary alarm system or in connection with existing alarm systems to provide additional safety in cases of fire.

Alarm 10 has a generally rectangular shaped housing 111 having a pan-shaped front plate 12 connected to a back plate 13 with fasteners 16. Front plate 12 has indicia 14, such as the word EXIT, mounted on the front surface thereof to indicate a way out of an enclosed space of a building. Indicia 14 can be other words and in any language or an outline of a pictogram, such as an arrow or chevron, to designate a point of departure from the building.

Figure 3:
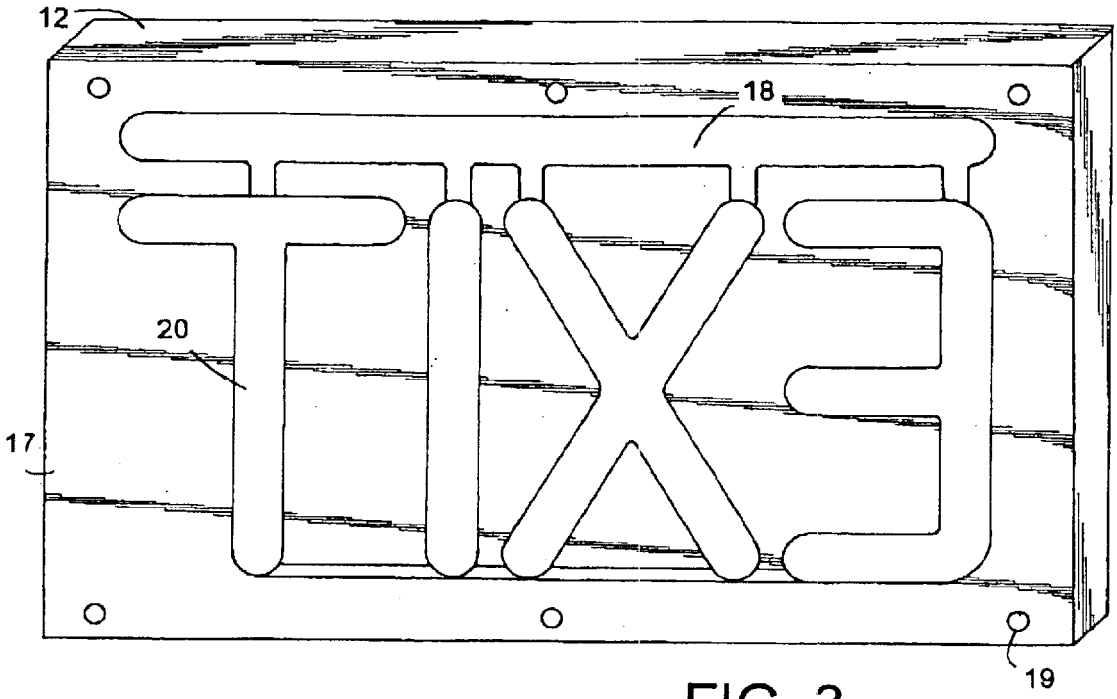
FIG. 3 is a rear perspective view of the alarm system of FIG. 1 with the back plate removed showing the sign chamber.

Referring to FIG. 3, a generally rectangular core 17 is accommodated by housing 11 of alarm 10. Core 17 has a chamber 18 for receiving a chemical solution that produces chemiluminescent light. Chamber 18 has an inner portion 20 having a shape substantially the same as the shape of indicia 14 to illuminate indicia 14. Core 17 has a plurality of holes 19 for accommodating fasteners 16. Core 17 is removable from housing 11 for cleaning of chamber 18 before recharging alarm 10.

Figure 4:
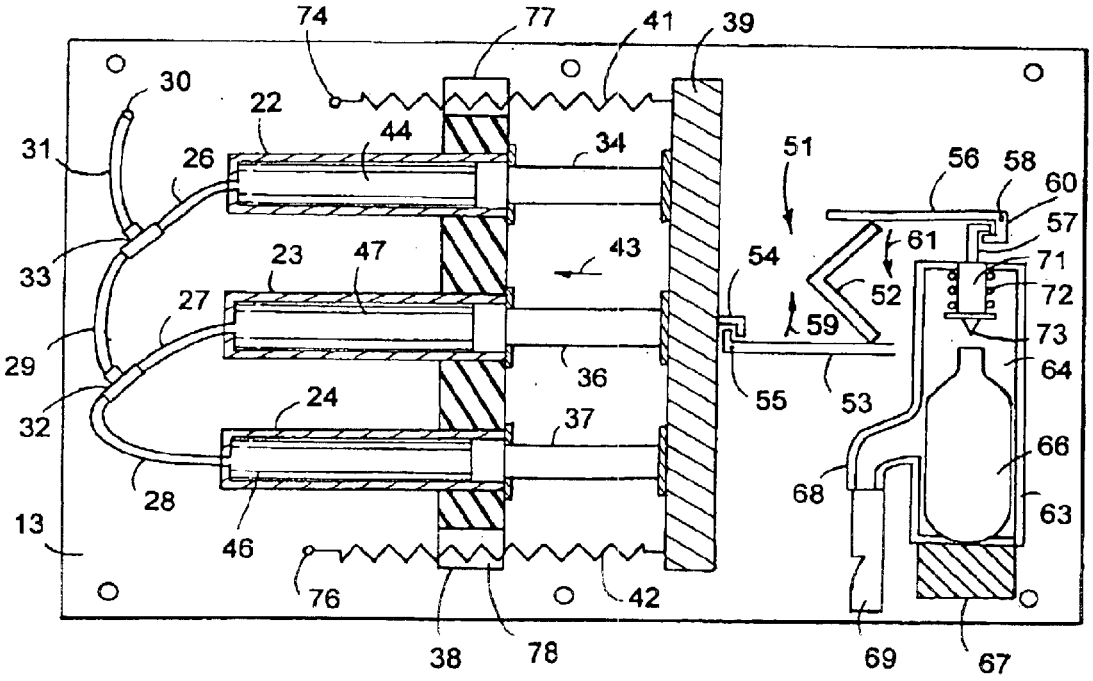
FIG. 4 is a sectional view similar to FIG. 2 showing the actuation and chemical mixing mechanisms of the alarm system.

As shown in FIGS. 2 and 4, a spring-loaded admixing member having syringe-type action, indicated at 21, is secured to back plate 13. Admixing member 21 is used to prepare and move a chemical solution having chemiluminescent properties into chamber 18 of core 17. Admixing member 21 has a plurality of elongated cylindrical tubes 22, 23 and 24 containing chemical solutions 44, 46 and 47 that when mixed produce light. Chemical solutions 44, 46 and 47 are kept separated in tubes 22 to 24. When chemical solutions 44, 46 and 47 flow together and are combined, the chemicals react to one another, and the atoms begin emitting light. Preferably, outer tubes 22 and 24 are filled with a phenyl oxalate ester and fluorescent dye solution. Middle tube 23 contains an activator solution, such as hydrogen peroxide solution. When the two solutions flow together, the resulting chemical reaction causes the fluorescent dye to emit light. Other chemical solutions can be used to produce chemiluminescent light.

Tubes 22, 23 and 24 fit into holes in a transverse plate or bracket 38 secured to housing 11. A plurality of plungers 34, 36 and 37 are moveable through tubes 22 to 24 to force chemical solutions 44, 46 and 47 to flow from the tubes through lines 26, 27, 28, 29 and 31 into chamber 18. Lines 26 to 29 and 31 are flexible plastic tubing adapted to carry chemical solutions 44, 46 and 47. Lines 26 to 29 and 31 can be cleaned with soap and water after use.

Middle line 27 attached to the outer end of middle tube 23 and outer line 28 attached to the outer end of outer tube 24 are coupled to an intermediate line 29 with a coupler 32. Outer line 26 attached to the outer end of outer tube 22 and the opposite end of intermediate line 29 are coupled to outlet line 31 with a coupler 33. Outlet line 31 extends through opening 30 in back plate 13. Line 31 is in open communication with the top of chamber 18. Chemical solutions 44, 46 and 47 flowing from lines 26, 27 and 28 flow together in lines 29 and 31 and into the top of chamber 18. As chemical solutions 44, 46 and 47 mix together and fill chamber 18 the chemical solutions 44, 46 and 47 chemically react to emit light and illuminate indicia 14.

The heads of plungers 34, 36 and 37 are attached to a moveable bar 39 which is biased toward bracket 38 with a pair of springs 41 and 42. Springs 41 and 42 extend linearly from bar 39 to pole anchors 74 and 76 attached to back plate 13 adjacent the outer ends of bracket 38. As shown in FIG. 4, springs 41 and 42 extend through notches 77 and 78 in the outer ends of bracket 38 to anchors 74 and 76. A heat responsive release, indicated at 51, connected to bar 39 controls the actuation of admixing member 21. Release 51 has a catch arm 53 pivotally attached to back plate 13 with a pivot pin 55. Arm 53 has an upwardly directed inner end that engages a hook latch 54 which is connected to bar 39 to hold admixing member 21 in a loaded position, as shown in FIG. 2. A center link 52 engages the opposite end of arm 53 to maintain the engagement of arm 53 and latch 54. Link 52 is a V-shaped fusible metal member, such as metal soldered together using a binary eutectic alloy, or easily melted alloy metals, that melts when elevated temperatures are present thereby releasing arm 53. Link 52 can be other heat responsive members which releases from arm 53 when the heat in the enclosed area surrounding link 52 exceeds a predetermined heat level. For example, link 52 can be a glass bulb filled with liquid glycerin which breaks and releases arm 53 when heated. When link 52 releases arm 53, arm 53 pivots, as shown by arrow 59 in FIG. 4, to release latch 54. Spring bar 39 is moved toward bracket 38 with springs 41 and 42, as shown by arrow 43 in FIG. 4, thereby moving plungers 34, 36 and 37 through tubes 22 to 24 discharging chemical solutions from the tubes.

A compressed air alarm, indicated at 62, is secured to back plate 13 adjacent syringe 21. Air alarm 62 is simultaneously activated to produce a high decibel audible sound when syringe 21 is activated to move chemical solutions 44, 46 and 47 from tubes 22, 23 and 24 and collect the solutions in chamber 18 to produce light. Alarm 62 has a generally cylindrical housing 63 with a chamber 64 accommodating a cartridge 66 containing a compressed gas, such as compressed carbon dioxide gas. The outer circumference of cartridge 66 is slightly less than the width of chamber 64 so that cartridge 66 has a sliding fit with housing 63. A removable cap 67 threaded on the lower end of housing 63 allows access to chamber 64 to inspect or replace cartridge 66. A spring-loaded actuator 71 extending through an opening in the top of housing 63 has an inner end 73 adapted to be moved into the top end of cartridge 66 to release the compressed gas contained in the cartridge 66. A spring 72 surrounding actuator 71 engages the top of housing 63 and a collar extending outwardly from inner end 73 to bias end 73 toward the top of cartridge 66.

A catch arm 56 pivotally attached to back plate 13 with a pivot pin 58 has a downwardly extended end 60 that engages a hook latch 57 connected to the outer end of actuator 71 to hold actuator 71 in a loaded position, as shown in FIG. 4. Center link 52 engages the opposite end of arm 56 to maintain the engagement of arm 56 and latch 57. When link 52 releases arm 56, arm 56 pivots, as shown by arrow 61 in FIG. 4, to release latch 57. Actuator 71 is moved toward cartridge 66 with spring 72 thereby moving end 73 into the top of cartridge 66 releasing compressed gas contained therein. The compressed gas released from cartridge 66 moves through an downwardly directed outlet tube 68 and through a whistle member 69 thereby producing a high decibel audible sound to audibly alert persons within hearing range of a high temperature occurrence, such as an enclosed fire. Link 52 simultaneously holds arms 53 and 56 in engagement with latches 54 and 57. When link 52 releases arms 53 and 56, the arms 53 and 56 pivot in opposite directions simultaneously resulting in the emission of light and production of sound.

In use, when elevated temperatures are present link 52 releases arms 53 and 56 allowing the arms 53 and 56 to pivot and release latches 54 and 57. Spring bar 39 is moved toward bracket 38 with springs 41 and 42 thereby moving plungers 34, 36 and 37 forwardly through tubes 22, 23 and 24 and discharging chemical solutions 44, 46 and 47 into lines 26, 27 and 28. Chemical solutions 44, 46 and 47 flow together through lines 29 and 31 into chamber 18 to illuminate indicia 14. Simultaneous with the delivery of chemical solutions 44, 46 and 47 to chamber 18 to produce chemiluminescent light, spring-loaded actuator 71 is driven into the top end of cartridge 66 since arms 53 and 56 are simultaneously released from latches 54 and 57. The high pressure gas contained in cartridge 66 is released and flows out of outlet 68 into whistle member 69 to produce a sound alert having a predetermined duration and decibel level.

To recharge alarm system 10, core 17 is removed from housing 11 and cleaned with a cleaning solution, such as soap and water. Tubes 22, 23 and 24 and lines 26 to 29 and 31 are also cleaned with a cleaning solution. Spring bar 39 is separated from bracket 38 and tubes 22 to 24 are filled with chemical solutions 44, 46 and 47. Arm 53 is pivoted to a transverse position to move the downwardly directed end of arm 53 into engagement with latch 54 attached to bar 39 to hold bar 39 in a retracted position, as shown in FIG. 4. Actuator 71 is separated from cartridge 66 and held in a retracted position by pivoting arm 56 to a transverse position moving end 60 into engagement with latch 57. Link 52 is replaced to simultaneously hold arms 53 and 56 in engagement with latches 54 and 57. The spent compressed gas cartridge 66 is removed from housing 63 by removing cap 67 from the lower end of housing 63. A new cartridge is inserted into housing chamber 64. Cap 67 is tighten on the lower end of housing 63 to enclosed the new cartridge in chamber 64.

Figure 5:
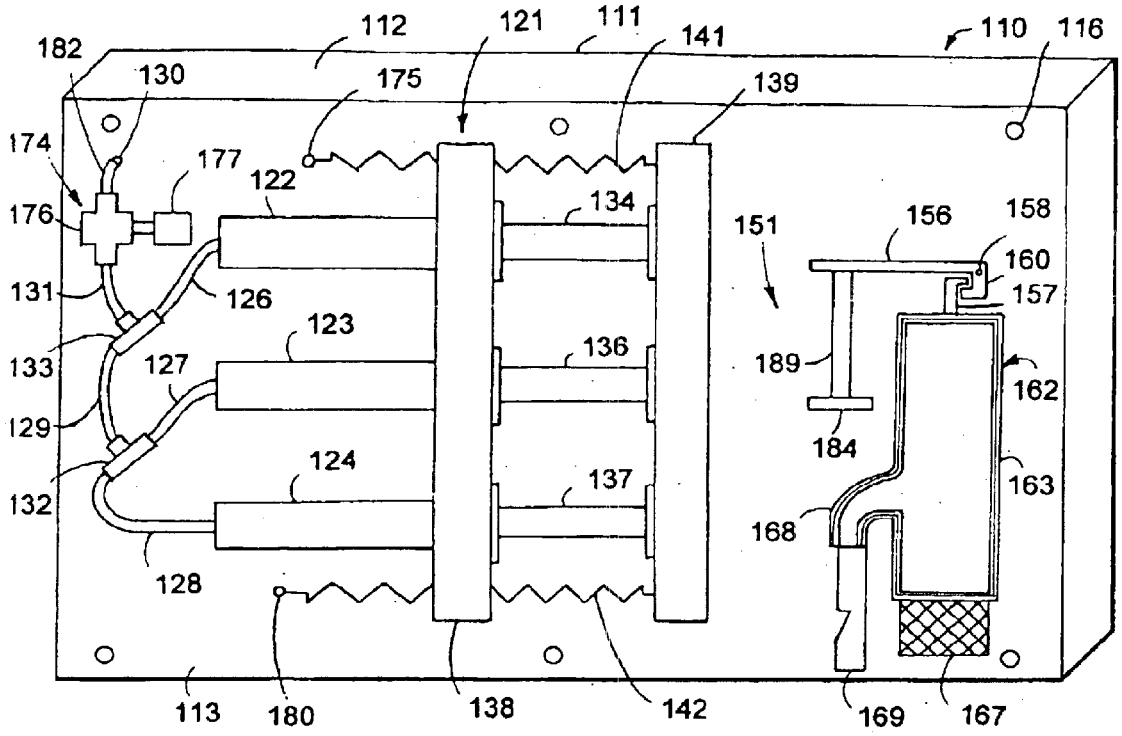
FIG. 5 is a rear perspective view of a modification of the alarm system of FIG. 1.
Figure 6:
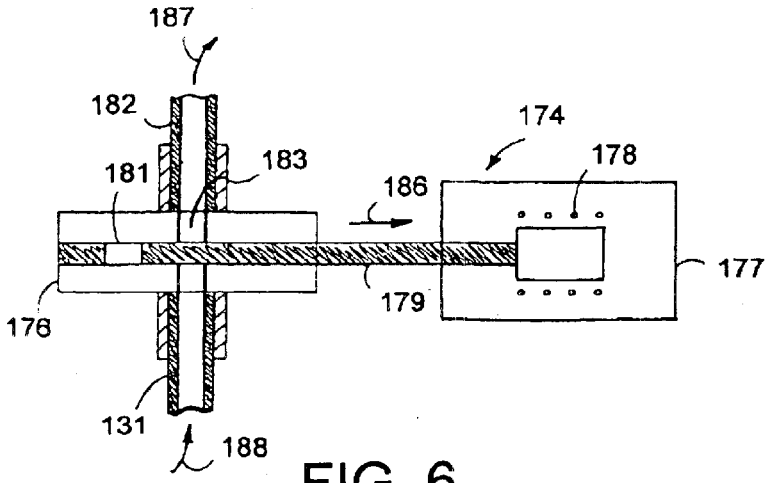
FIG. 6 is an enlarged sectional view of the control valve of the alarm system of FIG. 5.

A modification of the alarm system, indicated generally at 110, shown in FIGS. 5 and 6, is an alarm system responsive to temperature increase to provide a light source and an audible alert signal. The parts of alarm 110 that correspond to alarm 10 shown in FIGS. 1 to 4 have the same reference number with a prefix 1. Alarm 110 has a generally rectangular shaped housing 111 having a pan-shaped front plate 112 connected to a plate 113 with a plurality of fasteners 116. As shown in FIG. 5, a spring-loaded admixing member 121 mounted to back plate 113 is useable to combine chemical solutions contained in tubes 122, 123 and 124 of member 121. When combined the chemical solutions chemically react to produce chemiluminescent light and illuminate alarm 110.

Tubes 122, 123 and 124 are mounted on a transverse bracket 138 secured to back plate 113. Plungers 134, 136 and 137 attached to a moveable bar 139 are moved through tubes 122 to 124 to discharge the chemical solutions from the tubes 122 to 124 into lines 126, 127 and 128 and move the chemical solutions through lines 129, 131 and 182 and into a chamber located within housing 111 to prepare a chemiluminescent solution. Bar 139 is biased toward bracket 138 with springs 141 and 142 extended between anchors 175 and 180 and bar 139.

A solenoid-operated switch, indicated at 174, connected to lines 131 and 182 controls the actuation of admixing member 121. Switch 174 has a valve 176 operable to selectively block the flow of the chemical solutions through lines 131 and 182 thereby holding admixing member 121 in a loaded position, as shown in FIG. 5. Switch 174 has a solenoid 177 connected to a central alarm system, such as a central computerized fire system. Solenoid 177 has a wire coil 178. When the central alarm system sends a signal to energize coil 178, a moveable core 179 moves toward coil 178, as shown by arrow 186 in FIG. 6, to align a gate 181 with a passage 183 in valve 176 and the passages of lines 131 and 182. This allows the chemical solutions to be discharged from tubes 122 to 124, flow through lines 131 and 182, as shown by arrows 187 and 188, and opening 130 into the alarm chamber to illuminate alarm 110.

Returning to FIG. 5, a compressed air alarm 162 is secured to back plate 113 adjacent syringe 121. Air alarm 162 is activated to produce a high decibel audible sound alert when air alarm 162 is subjected to a predetermined elevated temperature. Alarm 162 has a housing 163 accommodating a cartridge which contains a compressed gas, such as compressed carbon dioxide gas. When the compressed gas is released from the cartridge, the gas flows out of housing 163 through a downwardly directed outlet 168 and into a whistle member 169. The lower end of housing 163 has an open end closed with a removable cap 167 to allow access to the cartridge.

A catch arm 156 has a downwardly extended end 160 that engages a hook latch 157 to hold compressed air alarm 162 in a loaded position, as shown in FIG. 5. Arm 156 is pivotally connnected to back plate 113 with a pivot member 158. A heat responsive release link 189 extending upwardly from a transverse mounting block 184 engages the opposite end of arm 156 to maintain arm 156 in a transverse position thereby maintaining the engagement of end 160 with latch 157. Preferably, line 189 is a glass bulb filled with liquid glycerin which breaks and releases arm 156 when heated to a predetermined temperature. Link 189 can be other heat responsive members which release arm 156 when heated to a selected heat level. When link 189 releases arm 156, the arm 156 pivots on pivot member 158 to release latch 157 causing the release of the compressed gas from housing outlet 168 through whistle member 169 thereby producing a relative loud sound alert.

Release 151 controls the actuation of compressed air alarm 162 separately from the actuation of admixing member 121, which is controlled by switch 174. Release 151 and switch 174 cam be adjusted to activate admixing member 121 and air alarm 162 simultaneously, in succession or at different heat levels.

The present disclosure are preferred embodiments of the light and sound alarm system. It is understood that the alarm system is not to be limited to the specific materials, constructions and arrangements shown and described. It is understood that changes in parts, materials, arrangement and locations of structures may be made without departing from the invention.

What is claimed is:

1. An emergency light and alarm comprising: a housing having an inner chamber for accommodating a chemiluminescent solution, means for preparing and delivering the chemiluminescent solution to the chamber, means for producing an audible sound alert, and first actuation means operably connected to the means for preparing and delivering the solution to chamber, the first actuation means operable responsive to a predetermined temperature to activate the means for preparing and delivering the chemiluminescent solution to the chamber, and second actuation means operably connected to the mean for producing an audible sound alert, the second actuation means responsive to a predetermined temperature to activate the means for producing an audible sound alert said first and second actuation means operating simultaneously.

2. The alarm of claim 1 wherein: the means for preparing and delivering the chemiluminescent solution to the chamber has admixing means mounted on the housing, the admixing means having a plurality of tubes, at least one of the tubes containing a first solution, another one of the tubes containing a second solution that when mixed with the first chemical solution results in the chemiluminescent solution, and means moveable through the tubes to force the first and second solutions out of the tubes and into the chamber whereby the first and second solutions are mixed together in the chamber to fill the chamber with the chemiluminescent solution.

3. The alarm of claim 2 wherein: the first solution is a phenyl oxalate ester and fluorescent dye solution, and the second solution is a hydrogen peroxide solution.

4. The alarm of claim 1 wherein: the means for producing an audible sound alert is a compressed air alarm.

5. The alarm of claim 1 wherein: the first actuation means has a solenoid-operated valve for selective controlling the means for preparing and delivering the chemiluminescent solution to the chamber.

6. An emergency light and alarm comprising: housing having an inner chamber for accommodating a chemiluminescent solution, means for preparing and delivering the chemiluminescent solution to the chamber, means for producing an audible sound alert, and actuation means operably connected to the means for preparing and delivering the solution to chamber and the means for producing an audible sound alert, the actuation means responsive to a predetermined elevated temperature to activate the means for preparing and delivering the chemiluminescent solution to the chamber and the means for producing an audible sound alert, the actuation means having link means releasably connected to the means for preparing and delivering the solution to the chamber and the means for producing an audible sound alert, the link means simultaneously releasing the means for preparing and delivering the solution to the chamber and the means for producing an audible sound alert at said predetermined elevated temperature whereby the means for preparing and delivering the solution to the chamber and the means for producing an audible sound alert are simultaneously activated.

7. The alarm of claim 6 wherein: the link means is a fusible link that melts at the predetermined elevated temperature.

8. The alarm of claim 6 wherein: the link means is a glass bulb filled with liquid glycerin that breaks at the predetermined elevated temperature.

9. A combined emergency light and alarm comprising: a housing having a front plate and a back plate surrounding an inner core having a chamber for accommodating a chemiluminescent solution to emit chemiluminescent light visible through the front plate, admixing means connected to the back plate for preparing and delivering the chemiluminescent solution to the chamber, the admixing means having a plurality to tubes, at least one of the tubes containing a first solution, at least one of the other tubes containing a second solution separate from the first solution, sound alarm means connected to the back plate adjacent the admixing means operable to produce an audible sound alert, actuation means operably connected to the admixing means and sound alarm means, the actuation means responsive to a predetermined heat level to simultaneously activate the admixing means and the sound alarm means thereby simultaneously causing the first and second solutions to be moved from the tubes into the chamber to prepare the chemiluminescent solution and produce the audible sound alert.

10. The alarm of claim 9 wherein: the admixing means has a plurality of plungers accommodated by the tubes, the plungers movable through the tubes to discharge the first and second solutions from the tubes.

11. The alarm of claim 9 wherein: the admixing means has a spring-loaded bar, the actuation means releasably connected to the bar to hold the bar in a loaded position.

12. The alarm of claim 9 wherein: the sound alarm means has a spring-loaded actuator member, the actuation means releasably connected to the actuator member to hold the actuator member in a loaded position.

13. The alarm of claim 9 wherein: the first solution is a phenyl oxalate ester and fluorescent dye solution, and the second solution is a hydrogen peroxide solution.

14. The alarm of claim 9 wherein: the sound alarm means is a compressed air alarm.

15. A method of producing a combined non-electrical light and sound alarm in response to an elevated temperature comprising: separating a first solution from a second solution that when combined results in a chemiluminescent solution, maintaining the separation of the first and second solutions at temperatures below the elevated temperature, sensing the elevated temperature, activating actuation means responsive to the elevated temperature to simultaneously combine the first and second solutions to prepare the chemiluminescent solution and activate a sound alarm to produce an audible alert signal.

16. The method of claim 15 including: delivering the chemiluminescent solution to a chamber.

17. The method of claim 16 including: illuminating indicia adjacent the chamber.

18. The method of claim 15 including: containing compressed air in a container, releasing the compressed air from the container, and directing the compressed air through whistle means when the elevated temperature is sensed.

19. The method of claim 15 wherein: the first solution is a phenyl oxalate ester and fluorescent dye solution, and the second solution is a hydrogen peroxide solution.

20. The method of claim 15 including: maintaining the audible alert signal for a predetermined period of time and at a selected decibel level.

* * * * *